US009511505B2

(12) United States Patent
Ohnishi et al.

(10) Patent No.: US 9,511,505 B2
(45) Date of Patent: Dec. 6, 2016

(54) PLASTIC FILM PUNCHING APPARATUS

(71) Applicant: Totani Corporation, Kyoto (JP)

(72) Inventors: Yuji Ohnishi, Kyoto (JP); Shoichi Sawada, Kyoto (JP)

(73) Assignee: Totani Corporation, Kyoto (JP)

( * ) Notice: Subject to any disclaimer, the term of this patent is extended or adjusted under 35 U.S.C. 154(b) by 153 days.

(21) Appl. No.: 14/464,772

(22) Filed: Aug. 21, 2014

(65) Prior Publication Data

US 2015/0059544 A1 Mar. 5, 2015

(30) Foreign Application Priority Data

Aug. 30, 2013 (JP) ..... 2013-179442

(51) Int. Cl.

| | |
|---|---|
| ***B26D 1/00*** | (2006.01) |
| ***B26D 7/18*** | (2006.01) |
| ***B26D 1/06*** | (2006.01) |
| ***B26F 1/14*** | (2006.01) |
| ***B26F 1/38*** | (2006.01) |
| ***B26D 7/14*** | (2006.01) |
| ***B26F 1/44*** | (2006.01) |
| *B26D 7/00* | (2006.01) |

(52) U.S. Cl.

CPC ..... *B26D 7/1854* (2013.01); *B26D 1/0006* (2013.01); *B26D 1/065* (2013.01); *B26D 7/14* (2013.01); *B26F 1/14* (2013.01); *B26F 1/3846* (2013.01); *B26F 1/44* (2013.01); *B26D 2001/006* (2013.01); *B26D 2007/0018* (2013.01); *Y10T 83/242* (2015.04); *Y10T 83/9423* (2015.04)

(58) Field of Classification Search

CPC ..... B26D 1/0006; B26D 1/065; B26D 7/14; B26D 7/1854; B26F 1/14; B26F 1/3846; B26F 1/44; Y10T 83/242

See application file for complete search history.

(56) References Cited

U.S. PATENT DOCUMENTS

| | | | | |
|---|---|---|---|---|
| 1,761,207 | A * | 6/1930 | Guertin | B26F 1/3846 30/358 |
| 1,911,873 | A * | 5/1933 | Balton | B26D 3/10 408/204 |
| 2,182,744 | A * | 12/1939 | Ehrsam | B28B 11/12 76/4 |
| 2007/0044618 | A1 | 3/2007 | Marks | |
| 2007/0056421 | A1 * | 3/2007 | Shimizu | B26F 1/14 83/571 |

FOREIGN PATENT DOCUMENTS

| | | |
|---|---|---|
| CN | 202462510 | 10/2012 |
| DE | 4441034 | 5/1996 |
| JP | S6039097 | 2/1985 |
| JP | S63-079199 | 5/1988 |
| JP | H04-035318 | 6/1992 |

(Continued)

*Primary Examiner* — Sean Michalski
*Assistant Examiner* — Liang Dong
(74) *Attorney, Agent, or Firm* — Kirschstein, Israel, Schiffmiller & Pieroni, P.C.

(57) ABSTRACT

A plastic film punching apparatus is improved to prevent a waste 15 from being caught in a cylindrical punch blade 2. The apparatus includes a punch blade 2 comprising a saw-toothed edge which includes mountain portions and valley portions formed alternately with each other. A protrusion 5 is disposed internally of the punch blade 2 to protrude beyond the position of height H1 of the bottoms 7 of valley portions and toward the position of height H2 of the tops 6 of mountain portions. An annular clearance 8 is formed between the punch blade 2 and the protrusion 5.

6 Claims, 3 Drawing Sheets

(56) References Cited

FOREIGN PATENT DOCUMENTS

| | | |
|---|---|---|
| JP | H04-051399 | 7/1992 |
| JP | H08-323692 | 12/1996 |
| JP | 2002-346986 | 12/2002 |
| JP | 2004-130461 | 4/2004 |
| WO | 2004009341 | 1/2004 |

* cited by examiner

PLASTIC FILM PUNCHING APPARATUS

TECHNICAL FIELD

The invention relates to a plastic film punching apparatus including a cylindrical punch blade by which a plastic film is punched so that an aperture should be formed in the plastic film.

BACKGROUND

There has been generally used a cylindrical punch blade by which a plastic film is punched so that an aperture should be formed in the plastic film. For example, Japanese Patent Publication No. 35,318 of 1992 discloses a cylindrical punch blade moved toward a plastic film and a die to be pressed against the plastic film, the plastic film being sandwiched between the punch blade and the die. The plastic film is therefore punched by the punch blade and the die so that an aperture should be formed in the plastic film. The patent publication further discloses that the punch blade is moved toward the plastic film and a receiver to be pressed against the plastic film, the plastic film being sandwiched between the punch blade and the receiver. The punch blade is rotated by a drive to make the plastic film punched.

In addition, there exists a problem that the plastic film generates a waste when being punched. The waste may be caught in the punch blade. In this connection, in the apparatus of the patent publication, the punch blade includes a spring and a pin received therein so that the waste should be removed by the spring and the pin after the plastic film is punched.

On the other hand, for example, in a machine for successively making plastic bags of plastic film, it may be required to make a number of apertures formed in the plastic film so that the plastic bag should include the apertures formed therein for venting. In this case, in order to make the apertures formed in the plastic film by utilizing the apparatus of the patent publication, not only the punch blades but also the dies or the drives for rotation have to be disposed in the positions of apertures, to be high in cost.

In addition, the apertures have to be formed in the plastic bag to be small in diameter for venting. In this connection, it is difficult to make the spring and the pin received in the punch blade. The punch blade can therefore include no spring and pin by which the waste is removed, resulting in the problem of the waste being caught in the punch blade.

By the way, Japanese Patent No. 3,655,627 discloses a machine for successively making plastic bags in which plastic films are fed longitudinally thereof and intermittently. The plastic films are heat sealed with each other and cross cut by a heat seal device and a cutter when the plastic films are stopped temporarily whenever being fed intermittently, to successively make the plastic bags. The same is true of the punch blade. The plastic film is punched by the punch blade when the plastic films are stopped temporarily whenever being fed intermittently.

It is therefore an object of the invention to provide a plastic film punching apparatus improved to prevent the waste from being caught in the punch blade, without involving the problem of cost.

SUMMARY OF THE INVENTION

According to the invention, the apparatus includes a cylindrical punch blade comprising a saw-toothed edge which includes mountain portions and valley portions formed alternately with each other. The mountain portions have tops formed at a position of height. The valley portions have bottoms formed at a position of height. The apparatus further includes a protrusion disposed internally of the punch blade to protrude beyond the position of height of the bottoms of valley portions and toward the position of height of the tops of mountain portions. The protrusion is fixed with respect to the punch blade. The apparatus further includes an annular clearance formed between the punch blade and the protrusion. The apparatus further includes a drive by which the punch blade and the protrusion are pressed against a plastic film. The plastic film is pierced with the tops of mountain portions and stretched by the protrusion. The punch blade is therefore thrust into the plastic film about the protrusion. The plastic film is introduced into the annular clearance and lacerated by the punch blade. The plastic film is lacerated to the bottoms of valley portions in the annular clearance to be punched by the punch blade so that an aperture should be formed in the plastic film, the plastic film generating a waste. In addition, the waste contracts into an original state after the plastic film is punched so that the protrusion should receive a reaction of contraction. The waste is removed by the reaction.

In a preferred embodiment, the protrusion is formed of a rigid body not to be deformed when being pressed against the plastic film.

The protrusion is disposed coaxially with the punch blade.

The protrusion has a shape of truncated cone to include an end formed of a circular surface or a circular line.

The protrusion protrudes to the position of height of the tops of mountain portions.

The apparatus further includes an air passage formed in the protrusion to extend in a direction in which the protrusion protrudes. Air is ejected from the passage.

BEST MODE TO CARRY OUT THE INVENTION

Figure 1:
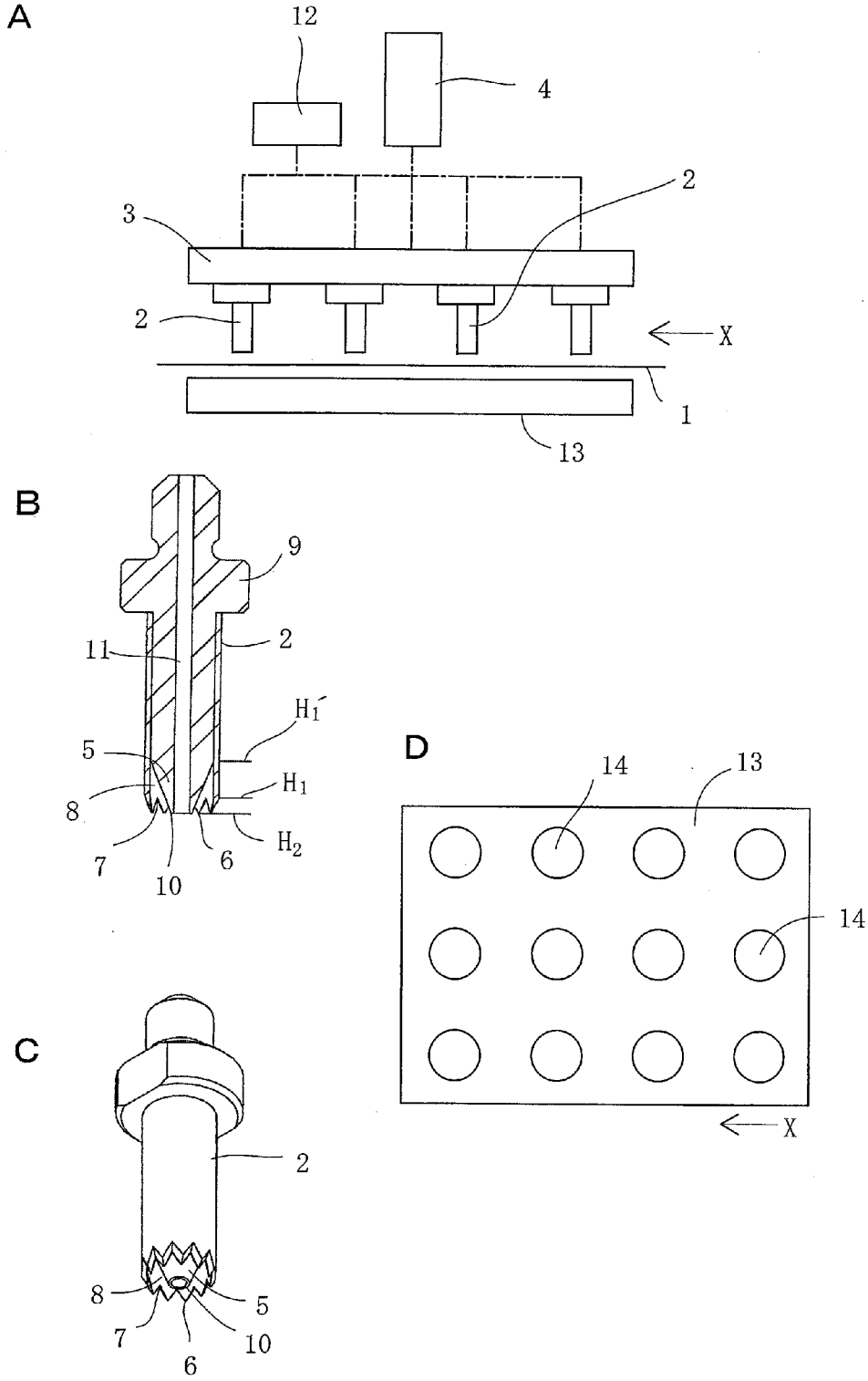
FIG. 1 is a side view (A) of a preferred embodiment of the invention, a sectional view (B) of the punch blade of (A), a perspective view (C) of the punch blade of (A) and a plan view (D) of the receiver of (A).

Turning now to the drawings, FIG. 1 illustrates a plastic film punching apparatus according to the invention. The apparatus is incorporated into a machine for successively making plastic bags of plastic film 1, the apparatus including a cylindrical punch blade 2. It should be understood that the terms of "cylindrical punch blade" means a hollow punch blade having a shape of true circle, ellipse or approximate geometry in section. In the machine, plastic films 1 are fed longitudinally thereof and intermittently, as in the case of the machine of Japanese Patent No. 3,655,627. The plastic films 1 are heat sealed with each other and cross cut by a heat seal device and a cutter when the plastic films 1 are stopped temporarily whenever being fed intermittently, to successively make plastic bags. It should also be understood that one of the plastic films 1 is shown in FIG. 1. The plastic films 1 are fed in a direction X longitudinal thereof. In addition, the plastic film 1 is punched by the punch blade 2 so that an aperture should be formed in the plastic film 1.

The apparatus includes a number of punch blades 2 extending downward to be disposed above the plastic film 1 and at a position of height. The punch blades 2 are spaced from each other longitudinally and widthwise of the plastic film 1 and supported by a plate 3 which is connected to and supported by a drive 4 such as a cylinder. The plate 3 and the punch blades 2 are moved downward by the drive 4, the plastic film 1 being punched by the punch blades 2, so that a number of apertures should be formed in the plastic film 1. The plastic bag therefore includes the apertures formed therein for venting, when making the plastic bags.

Each of the punch blades 2 comprises a saw-toothed edge which includes mountain portions and valley portions formed alternately with each other. The mountain portions have tops 6 formed at a position of height H2. The valley portions have bottoms 7 formed at a position of height H1. The saw-toothed edge is used as those of kitchen knife, wrap cutter and the like to be known in itself. However, all of them are different from the apparatus in that the saw-toothed edge is straight while in the apparatus, a cylindrical punch blade 2 is formed of the saw-toothed edge. The apparatus further includes a protrusion 5 disposed internally of the punch blade 2 to protrude beyond the position of height H1 of the bottoms 7 of valley portions and toward the position of height H2 of the tops 6 of mountain portions. The protrusion 5 is fixed with respect to the punch blade 2. The apparatus further includes an annular clearance 8 formed between the punch blade 2 and the protrusion 5.

In the embodiment, the punch blade 2 is fitted with a holder 9 which is mounted on the plate 3. The protrusion 5 is formed of the holder 9 to protrude beyond the position of height H1 of the bottoms 7 of valley portions and toward the position of height H2 of the tops 6 of mountain portions. The protrusion 5 is disposed coaxially with the punch blade 2.

The protrusion 5 has a shape of truncated cone to include an end 10 formed of a circular surface or a circular line. The annular clearance 8 therefore has a shape of wedge in section. The annular clearance 8 extends more deeply than the valley portions of the punch blade 2.

In addition, the protrusion 5 protrudes to the position of height H2 of the tops 6 of mountain portions. The end 10 is therefore formed at the position of height H2 of the tops 6 of mountain portions.

In the apparatus, the protrusion 5 protrudes beyond the position of height H1 of the bottoms 7 of valley portions and toward the position of height H2 of the tops 6 of mountain portions. The end 10 is formed at the position of height H2 of the tops 6 of mountain portions. It should therefore be understood that the annular clearance 8 is formed between the punch blade 2 and the protrusion 5 in a range of height H1-H2 to the end 10 of protrusion 5 from the bottoms 7 of valley portions. It should also be understood that the annular clearance 8 is formed between the punch blade 2 and the protrusion 5 in a range of height H1-H2 to the tops 6 of mountain portions from the bottoms 7 of valley portions. In addition, the annular clearance 8 extends more deeply than the valley portions. The protrusion 5 protrudes from the position of height H1' of the bottom of annular clearance 8. It should therefore be understood that the annular clearance 8 is formed between the punch blade 2 and the protrusion 5 in a range of height H1'-H2 to the end 10 of protrusion 5 from the bottom of annular clearance 8. It should also be understood that the annular clearance 8 is formed between the punch blade 2 and the protrusion 5 in a range of height H1'-H2 to the tops 6 of mountain portions from the bottom of annular clearance 8.

The apparatus further includes an air passage 11 formed in the holder 9 and the protrusion 5 to extend in a direction in which the protrusion 5 protrudes. An air supply 12 is connected to the passage 11. Air is therefore ejected from the passage 11.

A receiver 13 is disposed below the plastic film 1. The receiver 13 includes a number of apertures 14 formed therein. The apertures 14 are circular, each of which has a diameter greater than the punch blade 2. The apertures 14 are formed at positions corresponding to the punch blades 2.

Figure 2:
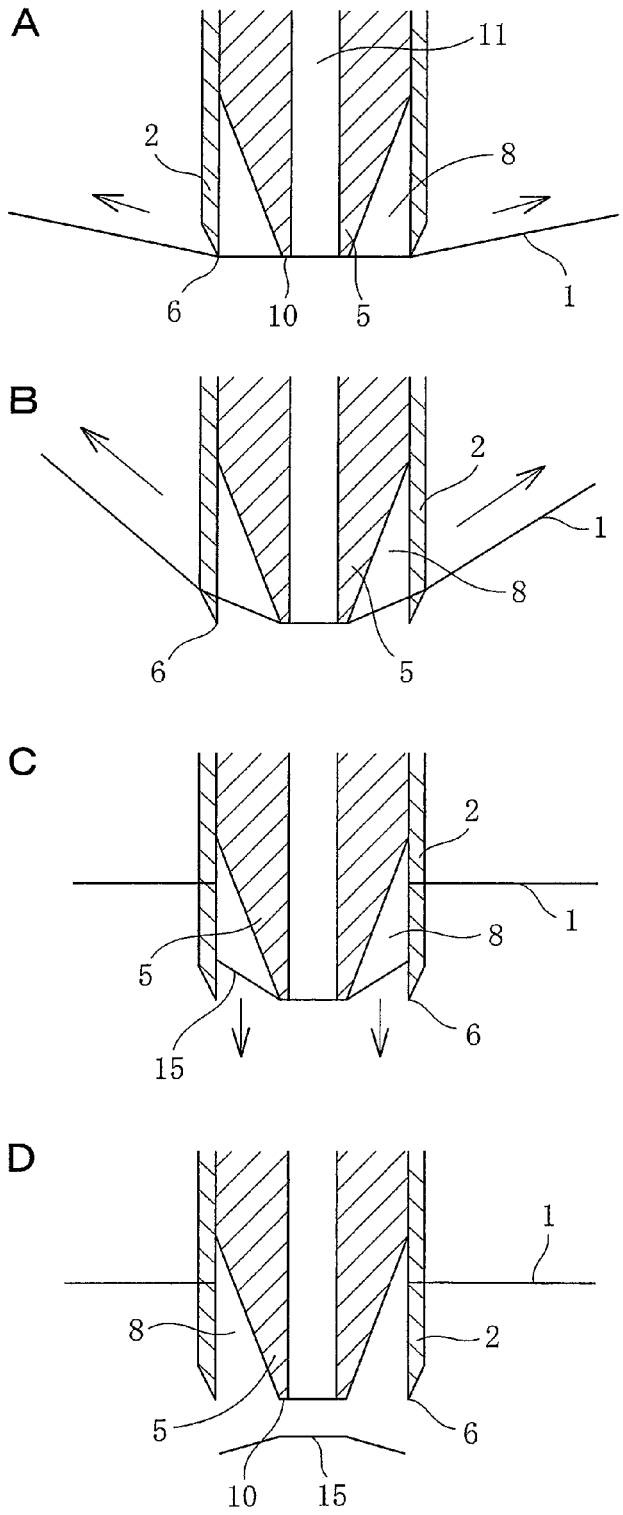
FIG. 2 is an explanatory view (A) of the plastic film of FIG. 1 when being punched, an explanatory view (B) of the step next to (A), an explanatory view (C) of the step next to (B) and an explanatory view (D) of the step next to (C).

In the apparatus, the plate 3 is lowered by the drive 4 so that the punch blades 2 and the protrusions 5 are moved downward toward the plastic film 1, when the plastic film 1 is stopped temporarily whenever being fed intermittently. The punch blade 2 and the protrusion 5 are therefore pressed against the plastic film 1. The plastic film 1 is pushed downward by the punch blade 2 and the protrusion 5 to be engaged with the receiver 13. The plastic film 1 is pierced with the tops 6 of mountain portions in the position of aperture 14 of receiver 13, as shown in FIG. 2 (FIG. 2A).

In addition, the plastic film 1 is pushed downward and stretched by the punch blade 2 and the protrusion 5 which are moved downward. A tension is given to the plastic film 1 so that the punch blade 2 should be thrust into the plastic film 1 about the protrusion 5. The plastic film 1 is introduced into the annular clearance 8 and lacerated by the punch blade 2 (FIG. 2B). The plastic film 1 is lacerated to the bottoms 7 of valley portions in the annular clearance 8 to be punched by the punch blade 2 so that an aperture should be formed in the plastic film 1, the plastic film 1 generating a waste 15.

The protrusion 5 is formed of a rigid body not to be deformed when being pressed against the plastic film 1. The plastic film 1 is pulled upward by tension after being punched (FIG. 2C).

In addition, in connection with the plastic film 1 pushed downward and stretched by the protrusion 5, the waste 15 contracts into an original state after the plastic film 1 is punched so that the protrusion 5 should receive a reaction of contraction. The reaction acts downward so that the waste 15 should be fallen and removed by the reaction. The waste 15 is engaged with the protrusion 5 and constrained by friction not to be rotated before being fallen. The waste 15 can therefore be fallen and removed smoothly (FIG. 2D).

The plate 3 is then lifted by the drive 4 so that the punch blade 2 and the protrusion 5 should be separated from and disposed above the plastic film 1. Subsequently, the plastic films 1 are fed intermittently again. The plate 3 is lowered again when the plastic films 1 are stopped temporarily, the same steps being performed repeatedly.

It should be understood that in the apparatus, the plastic film 1 is pierced with the tops 6 of mountain portions to be lacerated by the punch blade 2. The plastic film 1 is lacerated to the bottoms 7 of valley portions to be punched by the punch blade 2. Accordingly, unlike the apparatus of Japanese Patent Publication No. 35,318 of 19992, no die or drive for rotation is required, to be low in cost.

In addition, the waste 15 contracts into the original state after the plastic film 1 is punched so that the protrusion 5 should receive the reaction of contraction. The waste 15 is fallen and removed by the reaction. No waste is therefore caught in the punch blade 2. No spring and pin have to be received in the punch blade 2.

Air may be ejected from the passage 11. The waste 15 can therefore be pushed downward by the air to be fallen and removed reliably.

In the embodiment, the protrusion 5 has not always to protrude to the position of height H2 of the tops 6 of mountain portions. The plastic film 1 is pushed downward and stretched by the protrusion 5 before the plastic film 1 is punched, provided that the protrusion 5 protrudes beyond the position of height H1 of the bottoms 7 of valley portions and toward the position of height 112 of the tops 6 of mountain portions. The waste 15 is therefore fallen and removed by the reaction when the protrusion 5 receives the reaction.

By contraries, the protrusion 5 may protrude beyond the position of height H2 of the tops 6 of mountain portions at a slight amount. However, the amount should not be larger than one third of the outer diameter of punch blade 2. The plastic film 1 may not be punched by the punch blade 2 if the amount is larger than one third of the outer diameter of punch blade 2.

The plastic film 1 has not always to be pushed downward by the punch blade 2 and the protrusion 5 to be engaged with the receiver 13. The punch blade 2 and the protrusion 5 may be pressed against the plastic film 1 without using the receiver 15. In this case, a tension is given to the plastic film 1 so that the plastic film 1 should be punched by the punch blade 2. The waste 15 then contracts into the original state to be removed by the reaction of contraction.

Figure 3:
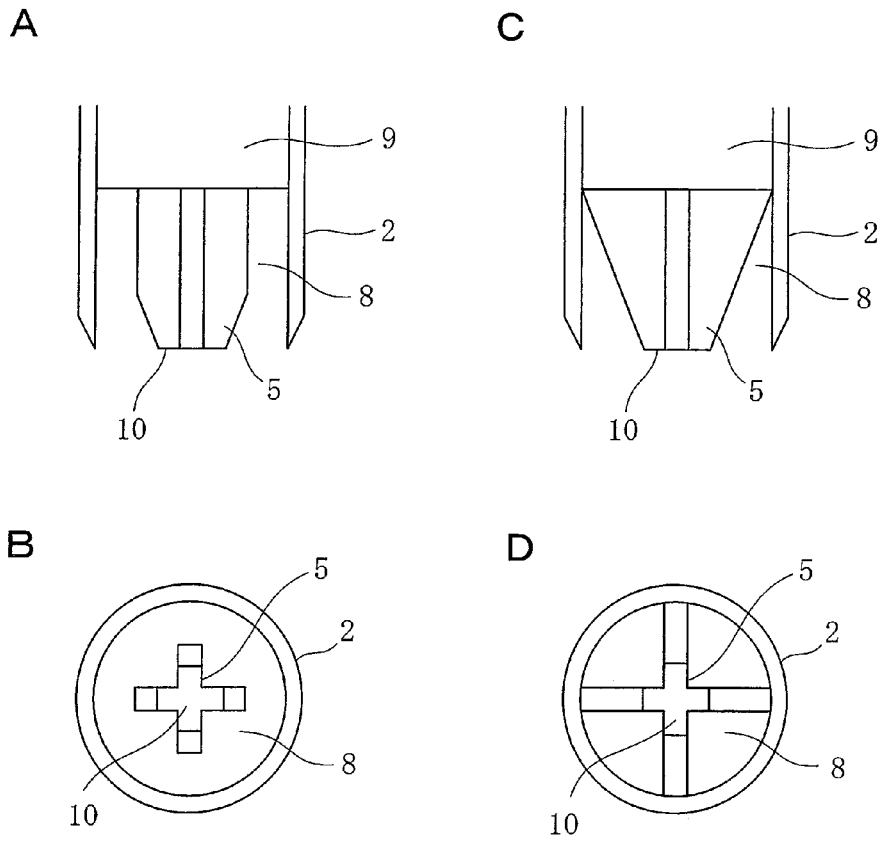
FIG. 3 is a sectional view (A) of another embodiment, a bottom view (B) of the punch blade of (A), a sectional view (C) of another embodiment and a bottom view (D) of the punch blade of (C).

The protrusion 5 has not always to have the shape of truncated cone. It may be cylindrical to have an outer diameter less than the inner diameter of the punch blade 2 so that an annular clearance 8 should be formed between the punch blade 2 and the protrusion 5. The protrusion 5 may be angular. The protrusion 5 and the holder 9 may be formed independently of and fixed to each other, as shown in FIG. 3. The protrusion 5 may have a shape of cross in section, to have an end 10 formed by a geometric surface or a geometric line so that the plastic film 1 should be pushed downward and stretched.

What is claimed is:

1. A plastic film punching apparatus comprising:

a cylindrical punch blade by which a plastic film is punched without using a die, the punch blade comprising a saw-toothed edge which includes mountain portions and valley portions formed alternately with each other, the mountain portions having tops formed at a first position of height, the valley portions having bottoms formed at a second position of height, the punch blade being hollow and fitted with a holder;

a protrusion formed of the holder and disposed internally of the punch blade to protrude beyond the second position of height of the bottoms of valley portions and toward the first position of height of the tops of mountain portions, the protrusion being fixed with respect to the punch blade;

an annular clearance formed between the punch blade and the protrusion; and a drive by which the punch blade and the protrusion are pressed against the plastic film, the plastic film being pierced with the tops of mountain portions and stretched by the protrusion, the punch blade being thrust into the plastic film about the protrusion, the plastic film being introduced into the annular clearance to be lacerated by the punch blade, the plastic film being lacerated to the bottoms of valley portions in the annular clearance to be punched by the punch blade so that an aperture is formed in the plastic film, the plastic film generating a waste;

wherein the waste contracts into an original state after the plastic film is punched so that the protrusion receives a reaction of contraction, the waste being removed by the reaction.

2. The apparatus as set forth in claim 1 wherein the protrusion is formed of a rigid body not to be deformed when being pressed against the plastic film.

3. The apparatus as set forth in claim 1 wherein the protrusion is disposed coaxially with the punch blade.

4. The apparatus as set forth in claim 1 wherein the protrusion has a shape of a truncated cone to include an end formed of a circular surface or a circular line.

5. The apparatus as set forth in claim 1 wherein the protrusion protrudes to the first position of height of the tops of mountain portions.

6. The apparatus as set forth in claim 1 further comprising an air passage formed in the protrusion to extend in a direction in which the protrusion protrudes, air being ejected from the passage.

* * * * *